United States Patent [19]

Phillips, Jr. et al.

[11] 4,255,089

[45] Mar. 10, 1981

[54] METHOD OF CONTROLLING SERIES FANS DRIVING A VARIABLE LOAD

[75] Inventors: William R. Phillips, Jr.; Ronald D. Tate, both of Denver County, Colo.

[73] Assignee: Dravo Corporation, Pittsburgh, Pa.

[21] Appl. No.: 22,769

[22] Filed: Mar. 22, 1979

[51] Int. Cl.[3] ..... F04B 41/06

[52] U.S. Cl. ..... 417/2; 417/17; 417/22

[58] Field of Search ..... 417/2, 17, 20; 318/4, 318/5

[56] References Cited

U.S. PATENT DOCUMENTS

| | | | |
|---|---|---|---|
| 1,080,582 | 12/1913 | Rateau | 417/20 |
| 1,837,382 | 12/1931 | Waller | 417/17 |
| 2,929,547 | 3/1960 | Koffel | 417/17 |
| 3,151,199 | 9/1964 | Flynn et al. | 266/85 |
| 3,332,621 | 7/1967 | Tanner | 236/46 R |
| 3,817,658 | 6/1974 | Murase | 417/2 |
| 3,922,110 | 11/1975 | Huse | 417/2 |
| 4,204,808 | 5/1980 | Reese et al. | 417/2 |

*Primary Examiner*—Billy S. Taylor

*Attorney, Agent, or Firm*—Parmelee, Miller, Welsh & Kratz

[57] ABSTRACT

Two series connected fans driving a variable throat venturi are controlled by a single flow control feedback loop yet are decoupled by modifying the common flow control signal by separate but complementary piecewise linear characterizations of the flow characteristics of each fan. Both fans are protected from surging and overcurrent by their own differential pressure and current limiting control loops respectively which automatically assume control when conditions warrant. The venturi is controlled by its own differential pressure control loop which is operated to generate the maximum differential pressure allowed by the flow rate without surging the fans.

13 Claims, 2 Drawing Figures

METHOD OF CONTROLLING SERIES FANS DRIVING A VARIABLE LOAD

FIELD OF THE INVENTION

This invention relates to controlling two fans connected in series to supply a down stream variable load.

PRIOR ART

Difficulty has been encountered to date in controlling two fans connected in series to drive a variable load especially when the fans are separated by very little volume. A situation of this nature is found in process off-gas systems such as that described in the commonly owned patent application Serial No. 22,770, filed Mar. 22, 1979 entitled "A Method of Process Off-Gas Control" filed concurrently herewith in the names of William R. Phillips, Jr., Ronald D. Tate and Radon Tolman. The variable load in that application is a variable throat venturi. In order for the venturi to have maximum effect, the differential pressure across it must be maximized. Therefore each fan must produce as much differential pressure as it is capable of without surging.

Current systems for controlling off-gas system fans employ various pressure-flow control loop configurations. Typically, the venturi position is controlled to maintain its differential pressure constant. Due to interaction between the two fans and the venturi, this type of control must be very sluggish which is unacceptable in discontinuous processes where flow variations are extreme. The typical venturi control must have a set point that will not surge either fan at minimum flow, nor limit flow below design flow; hence, it cannot maintain a maximum differential pressure across the venturi.

It is an object of the present invention to control a venturi to take the maximum available differential pressure over a wide range of flow rates.

It is another object of the invention to decouple two series fans so that each may develop its maximum differential pressure without surging while providing fast, stable control response over a wide range of flow conditions.

It is also an object of the invention to limit system flow under all conditions to a value which will not overload either fan motor.

SUMMARY OF THE INVENTION

In accordance with the invention, two series connected fans driving a downstream variable load are controlled by a single primary control signal, such as a flow control signal from a feedback flow control loop, yet they are effectively decoupled from each other by modifying the primary control signal by separate piecewise linear characterizations of the installed flow characteristics of each fan to generate isolated, modified control signals for the individual fans. The two piecewise linear flow characterizations are developed emperically to be complementary such that the total demand is efficiently divided between the two fans. With this arrangement, the two fans need not have the same flow characteristics and the advantages of one fan over the other at one end of the load curve or the other can be taken into account.

Each of the fans is protected from surging by its own differential pressure feedback control loop which continuously monitors the differential pressure across the associated fan and develops a differential pressure control signal for the fan using a representation of the maximum allowable differential pressure as the set point. The representation of the maximum allowable differential pressure is continuously generated from a piecewise linear characterization of the fan surge line, offset with an appropriate buffer, using the actual flow which is available from the flow control loop. The differential pressure control signal therefore represents, at any given instant, the maximum drive signal that can be applied to the fan without causing surging. Normally this signal is inactive; however, when the level of the differential pressure control signal drops below that of the primary control signal, indicating that the primary control signal would drive the fan into surge conditions, the primary control signal is rendered inactive and the differential pressure control signal takes over control of the fan. When the primary control signal again falls below the level of the differential pressure control signal control is returned to the primary control signal.

Each fan is also protected from overcurrent by its own current limiter control loop which continuously monitors motor current and generates a current control signal representative of the maximum drive signal that can be applied to the fan without exceeding, with an appropriate buffer, the motor current limits. This control signal is also normally inactive; however, whenever it falls below the level of the primary control signal and the differential pressure control signal it takes over control of the fan. The priorities are arranged such that the control signal with the lowest level is always the one that is controlling the fan. Thus, the fan may be run at its fullest capability but is always protected from surging and overcurrent.

The fans can be operated so that the control signal which is active for one fan is used as the primary control signal for the second fan. Thus, when the one fan goes into differential pressure control, the demand placed on the other fan is reduced accordingly even through it may not be near its surge limit. On the other hand, the second fan may go into differential pressure control while the one fan remains under primary control. This may be done where the one fan is substantially larger than the second fan.

Where the downstream variable load served by the fans is a variable throat venturi, venturi plug position is controlled by a feedback control loop utilizing the actual differential pressure across the two fans as the controlled variable and the maximum available differential pressure as the setpoint. Thus the venturi plug is driven toward a position which generates the maximum differential pressure across the venturi. As the venturi closes, the fan control responds to maintain constant flow thereby increasing the differential pressure developed by the fans. A piecewise linear characterization of the fan curve in the region where the fans begin to roll off is applied to the maximum differential pressure setpoint for the venturi controller to prevent full closure of the venturi which would shut down the system as the fans approach their maximum pumping capability.

DESCRIPTION OF THE PREFERRED EMBODIMENT

Figure 1:
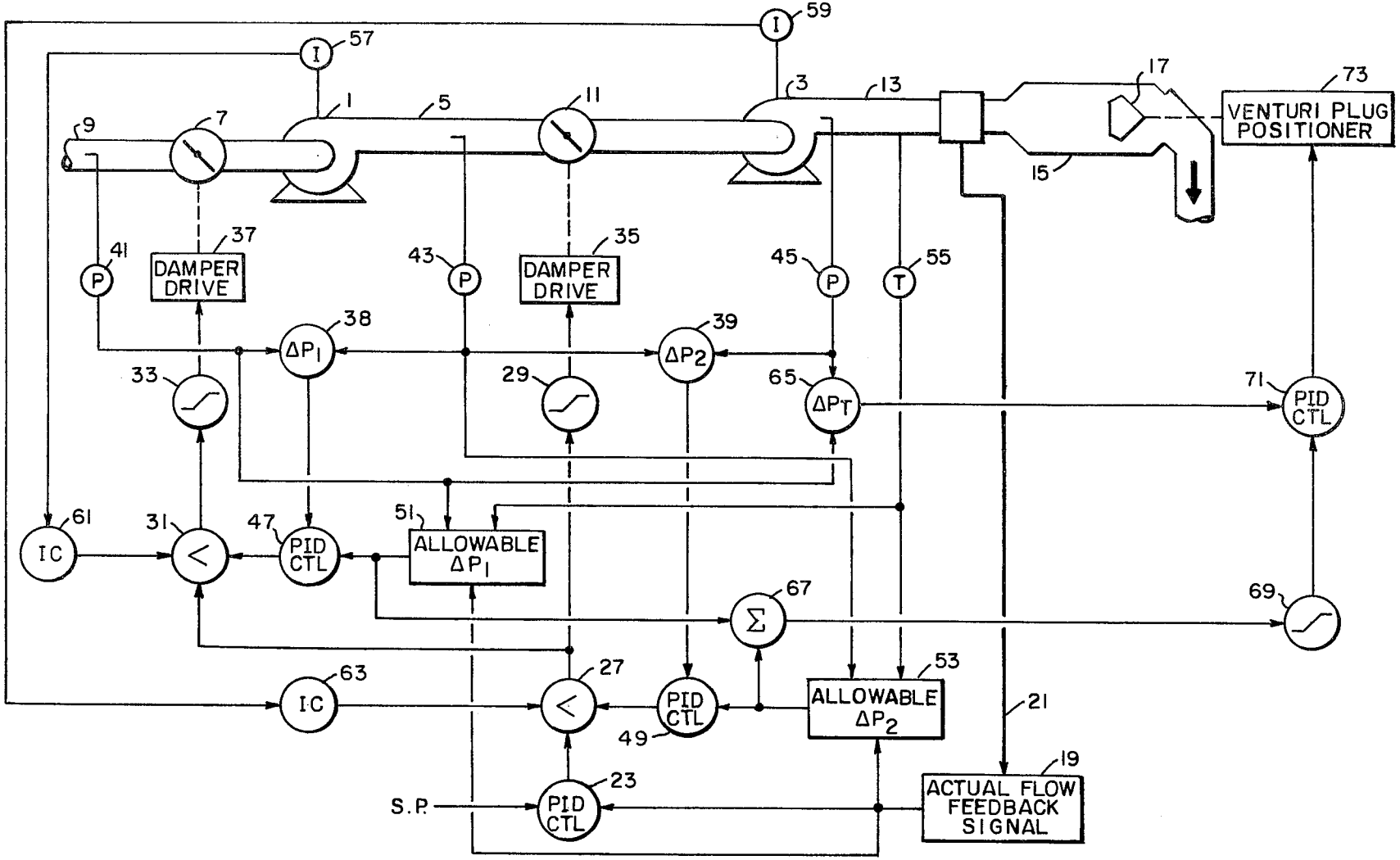
FIG. 1 is a schematic diagram of a system for controlling two fans in series driving a variable throat venturi in accordance with the principles of the present invention.

As illustrated in FIG. 1, two fans 1 and 3 are connected in series by a duct section 5 which because of the nature of the present invention may be made as short as possible. Also, because of the decoupling provided by the invention the fans 1 and 3 need not have the same characteristics and in fact, for the purposes of illustration, it will be assummed that the fan 1 is rated at 250 horsepower and fan 3 at 2000 horsepower. The fan 1 is controlled by a damper 7 in inlet duct section 9 and fan 3 is similarly controlled by a damper 11 in the connecting duct section 5. The discharge of fan 3 is connected by duct section 13 to variable throat venturi 15 having a movable plug 17.

Primary control for the fans is provided by a feedback flow control loop in which the controlled variable is the actual flow of gases through the fan system. The feedback signal for this loop is generated by the Actual Flow Feedback Signal Generator 19. A suitable signal generator of this type is described in detail in the previously mentioned copending application. This generator provides real time, on line analysis of the constituents of the gas being pumped by the fans from gas samples and temperature and pressure measurements taken from duct 13 as indicated by line 21. Of course, where the composition of the gas is stable over time, other simpler flow measuring devices could be used to generate the flow feedback signal.

The feedback signal generated by the Actual Flow Feedback Signal Generator 19 is applied to a flow controller 23. The setpoint S.P. for the controller 23 may be manually setable or it may be provided by a feedforward or cascade control loop, or both, such as in the arrangement illustrated in the copending application. In any event, the controller 23 applies proportional, integral and derivative control action to the feedback error signal to generate a primary control signal which is applied to a low select module 27. Low select module 27 is a device having several inputs and a single output which tracks the input having the lowest signal level. The output of low select module 27 is connected to a characterizer 29 and through a second low level select module 31, to another characterizer 33. The characterizers 29 and 33 modify the applied signal and apply the resultant signal to damper drives 35 and 37 which mechanically position dampers 11 and 7 respectively. Assuming for the present that the flow control signal generated by controller 23 is the lowest level signal applied to low select modules 27 and 31, the fan dampers will be controlled by the flow control loop.

The characterizers 29 and 33 decouple the fans by dividing the load between the two fans based upon their individual flow characteristics. In practice, the transfer functions of the characterizers can be determined emperically by operating the fans over the full flow range and manually balancing the positions of the two dampers to establish a desired pressure in duct 5 between the fans. By establishing the relative positions of the dampers at a sufficient number of flow rates, a piecewise linear approximation of the desired flow characteristics of each fan can be generated in a manner well known to those skilled in the control system art.

Each fan is also provided with a differential pressure control loop for surge protection. The controlled variable in this loop is the differential pressure across the associated fan and the setpoint is the maximum allowable differential pressure across the fan at existing flow conditions. The actual differential pressure across fans 1 and 3 is calculated in summers 38 and 39 respectively from the outputs of absolute pressure transmitters 41, 43 and 45 and the resultant feedback signals are applied to controllers 47 and 49 respectively. The setpoints for controllers 47 and 49 are generated by allowable differential pressure ($\Delta P$) signal generators 51 and 53 respectively. The maximum allowable differential pressure signals are generated as a function of the actual flow as determined by Actual Flow Feedback Signal Generator 19 and as corrected for absolute temperature and pressure conditions at the fan inlets by pressure signals from pressure transmitters 41 and 43 respectively and a temperature signal from absolute temperature transmitter 55. A single temperature reading can be used in the calculations since there is no appreciable change in the temperature of the gases across the fans.

Figure 2:
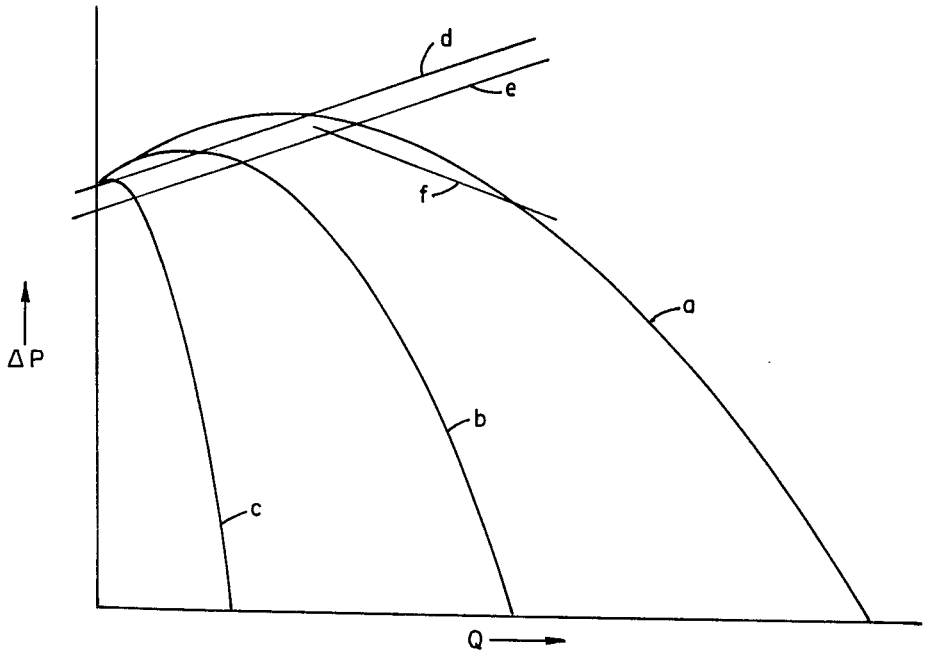
FIG. 2 is a typical fan curve illustrating the manner in which piecewise linear characterizations of portions of the fan curve are developed for use with the invention.

It would be useful in gaining an understanding of the manner in which the maximum allowable differential pressure signals are generated to refer to a typical set of fan curves such as those illustrated in FIG. 2. The abscissa of operating points on this figure represents flow Q and the ordinate represents differential pressure $\Delta P$. Lines a, b and c represent the flow characteristics for the illustrative fan with the dampers set at 100%, 95% and 50% open respectively. Thus for a given flow rate at a given damper position the differential pressure that the fan must develop can be determined. However, if an attempt is made to operate the fan under conditions which place the operating point above the line d, the fan will surge. Hence line d is referred to as the surge line. In order, to assure that the fan does not surge, a line e parallel to, but a short distance inside the surge line d was selected for the maximum allowable differential pressure. Since the line e is straight and intersects the vertical axis, a model can be easily constructed for the Allowable Differential Pressure Generators 51 and 53 using a multiplier with an appropriate bias. Before the flow signal from Actual Flow Feedback Signal Generator 19 is applied to the multiplier, however, it must be corrected for inlet temperature and pressure conditions as discussed above.

Returning to FIG. 1, the differential pressure control signals generated by the controllers 47 and 49 are applied to the low select circuits 27 and 31 respectively. If they are the lowest level signals applied to these low select circuits, they will be selected to control the respective fan dampers.

Each fan is also protected from overcurreents by a current limiting control loop. Current transmitters 57 and 59 generate feedback signals representative of the actual current drawn by fans 1 and 3 respectively for current controllers 61 and 63. The controllers compare the feedback signals with preset maximum current setpoint signals and generate appropriate control signals which are applied to the low select modules 31 and 27 respectively. If the current of either fan motor approaches the current limit the control signal generated by the associated current controller will be selected by the appropriate low select module to switch the fan to current limit control.

The venturi plug is also positioned by a feedback control loop in which the controlled variable is the total differential pressure developed by both fans and the setpoint is the total maximum allowable differential pressure that can be generated by both fans. Thus the total actual differential pressure across the fans is determined by summer 65 from the outputs of pressure transmitters 41 and 45 and the total maximum allowable differential pressure is likewise determined in summer 67 from the outputs of allowable differential pressure signal generators 51 and 53. The output of summer 67 is modified by a characterizer 69 with the resultant signal applied as the setpoint to venturi controller 71 while the output of summer 65 is applied directly to controller 71 as the feedback signal. The control signal generated by controller 71 is applied to venturi plug positioner 73 to regulate plug position.

Reference should be made again to FIG. 2 for an explanation of the reason for the characterizer 69. With the setpoint of the venturi control loop being the maximum allowable differential pressure, the venturi tends to close down thereby increasing the differential pressure as the fan dampers adjust to maintain the setpoint flow rate and eventually an equilibrum is reached. However, at high flow rates with the dampers near the full open position, the calculated allowable differential pressure characterized by line e exceeds the pumping capability of the fan as represented by line a. Under these circumstances, as the venturi tends to close down in an attempt to generate the maximum allowable differential pressure, the fans cannot develop any more differential pressure and the venturi closes even more. It is possible for the venturi to close completely under these conditions thus shutting down the system. The purpose then of the characterizer 69 is to limit the maximum differential pressure called for by the venturi to values which can be supplied by the fans. Such a limit is represented by the line f in FIG. 2 and the characterizer 69 modifies the maximum allowable differential pressure signal by limiting the output of the characterizer by a function approximated by the line f for the combined fan curves.

Under normal conditions then the system operates under flow control with the venturi positioned to generate maximum differential pressure for the flow conditions and with the load distributed between the fans in the manner specified by the characterizers 29 and 33. Should at any time, one of the fans approach its maximum allowable differential pressure the fan will be switched to differential pressure control. If the fan which goes into differential pressure control is the fan 3, the fan 1 will also be operated at a reduced level since the output of low select module 27 supplies the primary control signal for the fan 1, although the fan 1 will not necessarily go into differential pressure control itself. Likewise, if an overcurrent condition is approached by either fan, that fan will be switched to current limit control, and again the fan 1 will operate at a reduced level if the fan 3 goes on current limit control, although the fan 1 may still be in one of the other two control modes.

While specific embodiments of the invention have been described in detail it will be appreciated by those skilled in the art that various modifications and alternatives to the details disclosed herein could be developed which would still fall fully within the scope of the invention. For instance, while the invention has been described as being implemented by hardware it could also be implemented by software. Also the invention is applicable to other rotating fluid pumps such as compressors and to integrating the control of a variable throat venturi and a single fan. Accordingly, the particular arrangements disclosed are meant to be illustrative only and not as limiting on the scope of the invention which is to be given the full breadth of the appended claims and any and all equivalents thereof.

We claim:

1. A method of controlling two fans connected in series to drive a downstream variable load, said method comprising the steps of:

generating a single primary control signal representative of the total demand placed upon the two fans, generating a piecewise linear characterization of the installed flow characteristics of each fan, modifying the primary control signal as a function of the piecewise linear characterization of each fan to generate a modified control signal for each fan, and operating the control element of each fan as a function of the associated modified control signal, said piecewise linear characterizations being complementary such that the total demand placed upon the two fans is divided between the fans in a predetermined manner over the the range of said primary control signal.

2. The method of claim 1 including:

monitoring the actual differential pressure across one of said fans and the flow through the fans, generating a signal representative of the maximum allowable differential pressure across said one fan as a function of said flow, generating a first differential pressure control signal as a function of the difference between the actual differential pressure and the maximum allowable differential pressure signal, and generating the modified control signal associated with said one fan from said first differential pressure control signal instead of said primary control signal whenever the level of the first differential pressure control signal drops below the level of the primary control signal.

3. The method of claim 2 including the step of returning control of the one fan to the primary control signal whenever the level of the primary control signal drops below that of the first differential pressure control signal.

4. The method of claim 3 including generating the modified control signal for both fans from said first differential pressure control signal whenever its level drops below that of the primary control signal and returning both fans to control by the primary control signal whenever the level of the primary control signal drops below the level of the first differential pressure control signal.

5. The method of claim 3 including the steps of:

monitoring the motor current of said one fan, generating a first current control signal as a function of said monitored motor current, and selecting at all times from the primary control signal, the first differential pressure control signal and the first current signal, the signal having the lowest value and generating said modified control signal for said first fan therefrom.

6. The method of claim 4 including the steps of:

monitoring the differential pressure across the second fan, generating a signal representative of the maximum allowable differential pressure across said second fan as a function of the flow, generating a second differential pressure control signal as a function of the difference between the actual second fan differential pressure, and the second fan maximum allowable differential pressure signal, generating the modified control signal associated with said second fan from said second differential pressure control signal whenever its level drops below the level of the signal controlling the first fan, and returning control of the second fan to control by the signal controlling the first fan whenever the level of the signal controlling the first fan drops below that of the second differential pressure control signal.

7. The method of claim 6 wherein the variable load is an adjustable venturi and including the steps of:

generating a total differential pressure signal representative of the actual differential pressure across both fans, applying the total differential pressure signal to a controller to generate a venturi control signal, generating a total allowable differential pressure signal representative of the maximum differential pressure across both fans as a function of the flow, applying said total allowable differential pressure signal to said verturi controller as the setpoint therefore, and controlling the position of the venturi as a function of the venturi control signal.

8. The method of claim 7 including:

generating a piecewise linear characterization of the venturi as a function of flow, modifying said total allowable differential pressure signal by said venturi piecewise linear characterization, and applying said modified total allowable differential signal to said venturi controller as the set point, said piecewise linear characterization being selected to limit the differential pressure called for by the venturi at high flow rates where the differrential pressure of the fans begins to roll off.

9. A method of controlling a fan system driving a variable throat venturi comprising the steps of:

generating a flow control setpoint signal representative of desired flow through the fan system and venturi, controlling the fan system with a feedback control loop which generates a control signal using the actual flow through the fan system and venturi as the feedback signal and the desired flow as the setpoint, generating a representation of the maximum differential pressure that can be developed by the fan system for the existing flow rate without surging the fan system, and controlling the variable throat venturi with a feedback control loop using the actual differential pressure developed across the fan system as the controlled variable and said representation as the setpoint signal.

10. The method of claim 9 including the step of:

limiting the representation of the maximum differential pressure that can be developed by the fan system without surging in the region where the fan system operating characteristics roll off to a value just under the differential pressure that can be developed with the fan system controls full open.

11. The method of 10 including the steps of:

providing differential pressure feedback control for the fan system with a control loop which generates a differential pressure control signal using the actual differential pressure across the fan system as the controlled variable and said representation as the setpoint, and selecting differential pressure control in place of flow control when the control signal generated by the differential pressure control loop drops below the level of that generated by the flow control loop.

12. The method of claim 11 including the steps of:

providing current feedback control for the fan system with a control loop which generates a current control signal using the actual current of the fan system as the controlled variable and a preselected maximum current as the setpoint, and selecting the control loop that is generating the lowest level control signal for controlling the fan system.

13. The method of claim 12 wherein the fan system includes two fans connected in series and including the steps of:

providing common flow control but separate differential pressure control and current control for each fan, generating a piecewise linear characterization of the installed flow characteristics of each fan, said piecewise linear characterizations being complementary such that the total demand placed on the two fans is divided between the fans in a predetermined manner, and modifying the control signal selected for control of the fans by the piecewise linear characterization for each fan.

* * * * *